US006383120B1

(12) United States Patent
Lo

(10) Patent No.: US 6,383,120 B1
(45) Date of Patent: May 7, 2002

(54) TREADMILL HAVING A LOCKING DEVICE FOR LOCKING A DECK IN A FOLDED POSITION

(76) Inventor: Peter K. C. Lo, No. 3, Ching-Cheng-Ssu St., Taichung City (TW)

( * ) Notice: Subject to any disclaimer, the term of this patent is extended or adjusted under 35 U.S.C. 154(b) by 65 days.

(21) Appl. No.: 09/636,532

(22) Filed: Aug. 10, 2000

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 5,595,556 A * 1/1997 Dalebout et al. ..... 482/54
5,816,981 A * 10/1998 Hung ..... 482/54
5,833,577 A * 11/1998 Hurt ..... 482/54

* cited by examiner

*Primary Examiner*—Glenn E. Richman
(74) *Attorney, Agent, or Firm*—Trop, Pruner & Hu, P.C.

(57) ABSTRACT

A treadmill includes a horizontal frame, an upright frame disposed upwardly on a front portion of the horizontal frame, and a horizontal deck laid over the horizontal frame and having a front portion connected pivotally to the front portion of the horizontal frame so that the deck can be turned upwardly on the horizontal frame to a folded position, where the deck abuts against the upright frame. A locking device includes a front tube having a front end connected pivotally to the rear portion of the horizontal frame, and a front positioning hole formed in a rear end thereof. A rear tube has a rear end that is connected pivotally to the rear portion of the deck, a front end that is connected telescopically to the rear end of the front tube so that the deck can be folded on the upright frame, and a rear positioning hole formed therein such that rotation of the deck to the folded position causes the rear tube to move away from the front tube. A spring-biased lock pin is disposed on one of the front and rear tubes, and is biased to extend through the front and rear positioning holes in the front and rear tubes when the deck is rotated to the folded position.

6 Claims, 10 Drawing Sheets

TREADMILL HAVING A LOCKING DEVICE FOR LOCKING A DECK IN A FOLDED POSITION

BACKGROUND OF THE INVENTION

1. Field of the Invention

The invention relates to a treadmill, more particularly to a treadmill that has a locking device for locking a deck in a folded position.

2. Description of the Related Art

Referring to FIG. 1, a conventional treadmill 10 is shown to include a base member 11 and an elongated horizontal deck 12. The base member 11 includes a horizontal frame 110 with front and rear portions 111,112, a pair of upright posts 14,15 that are disposed and that extend upwardly from the front portion 111 of the horizontal frame 110, and a handgrip member 16 attached to upper ends of the upright posts 14,15. The horizontal deck 12 is laid over the base member 11, and has a front portion 121 connected pivotally to the front portion 111 of the horizontal frame 110 so that the deck 12 can be turned upwardly on the base member 11 to a folded position, and a rear portion 122 that abuts against the handgrip member 16 when the deck 12 is rotated to the folded position. A drawback of the aforesaid conventional treadmill resides in that, at the folded position, the deck 12 is only propped against the handgrip member 16. Thus, accidental collision to the deck 12 can result in falling of the same over the horizontal frame 12, thereby exposing a nearby person to the risk of injury.

SUMMARY OF THE INVENTION

Therefore, the object of this invention is to provide a treadmill with a locking device for locking a deck at a folded position in such a manner that the aforesaid drawback encountered during use of the conventional treadmill can be eliminated. Accordingly, the treadmill of the present invention includes a base member, an elongated horizontal deck, and a locking device. The base member includes a horizontal frame with front and rear portions, an upright frame that is disposed on and that extends upwardly from the front portion of the horizontal frame, and a handle member attached to an upper end of the upright frame. An elongated horizontal deck is laid over the horizontal frame of the base member, and has a front portion connected pivotally to the front portion of the horizontal frame so that the deck can be turned upwardly on the base member to a folded position, and a rear portion which abuts against the upright frame when the deck is rotated to the folded position. The locking device includes a front tube, a rear tube, and a spring-biased lock pin. The front tube has a front end connected pivotally to the rear portion of the horizontal frame in the base member, a rear end, and a front positioning hole formed therein. The rear tube has a rear end that is connected pivotally to the rear portion of the deck, a front end that is connected telescopically to the rear end of the front tube so that the deck can be folded on the upright frame of the base member, and a rear positioning hole formed therein such that rotation of the deck to the folded position causes the rear tube to move away from the front tube, thereby increasing total length of the front and rear tubes. The lock pin is disposed on one of the front and rear tubes, and is biased to extend through the front and rear positioning holes in the front and rear tubes when the deck is rotated to the folded position, thereby locking the deck at the folded position.

BRIEF DESCRIPTION OF THE DRAWINGS

These and other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
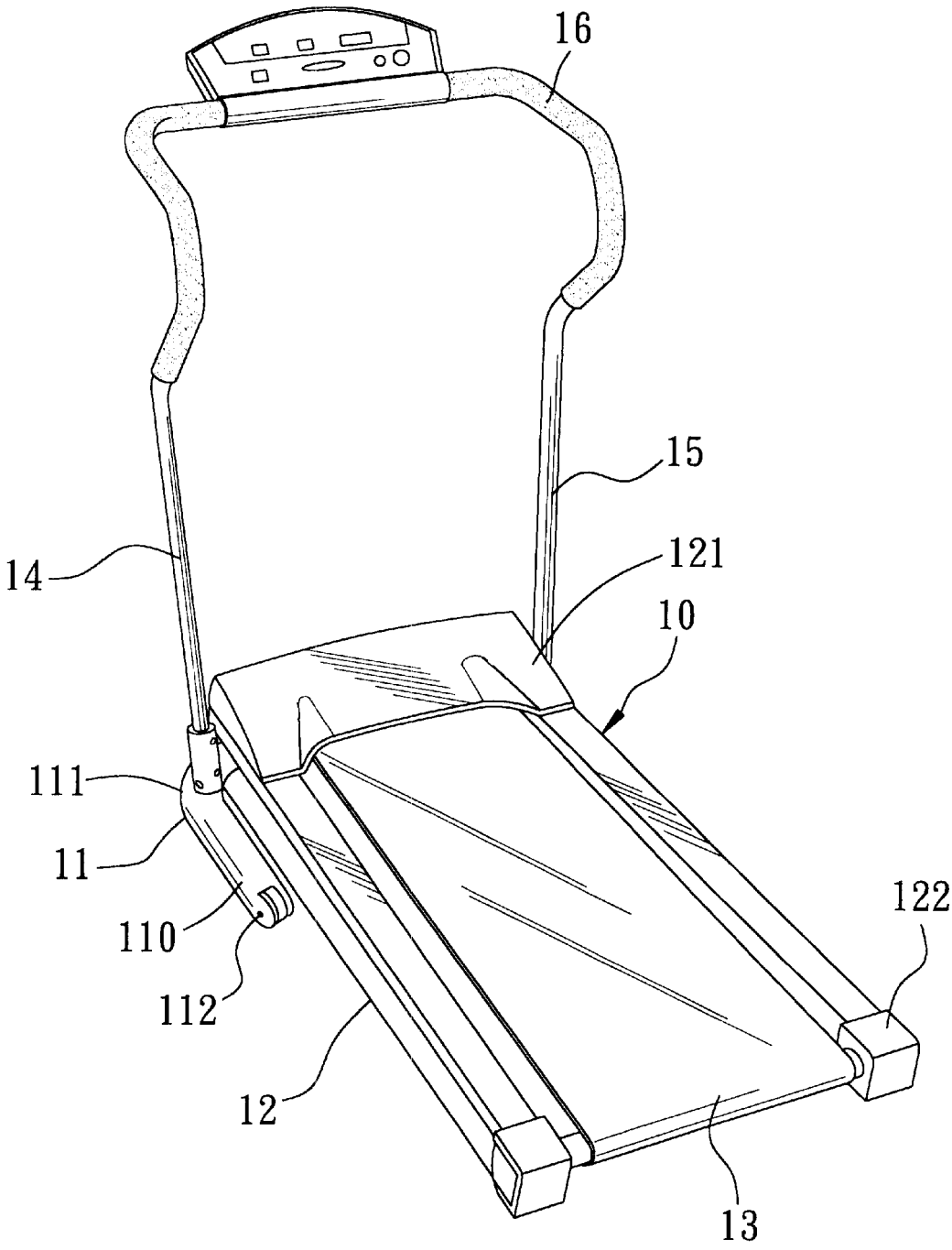
FIG. 1 PRIOR ART
FIG. 1 is a perspective view of a conventional treadmill in use.
Figure 2:
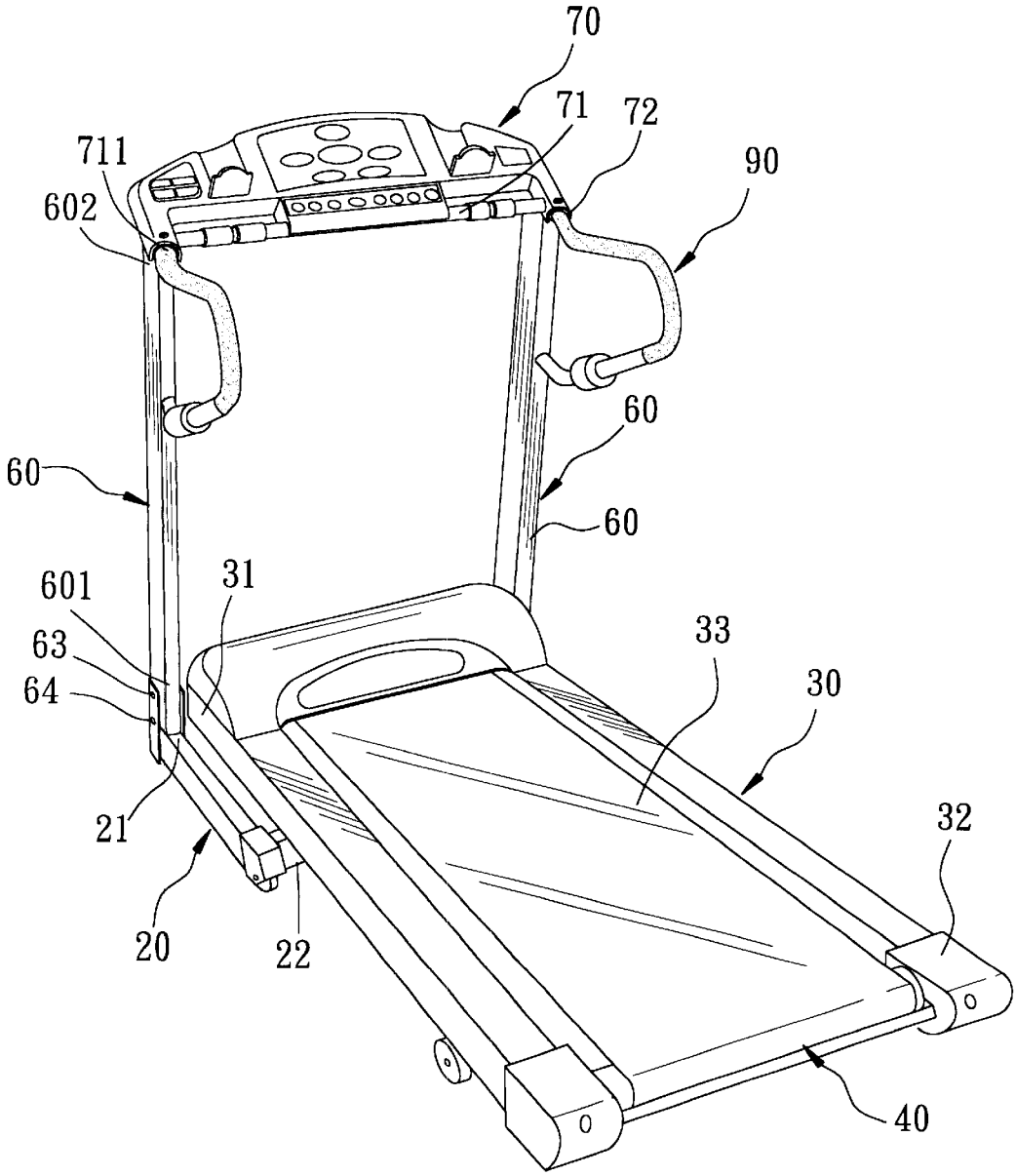
FIG. 2 is a perspective view of a preferred embodiment of a treadmill of the present invention in use.
Figure 3:
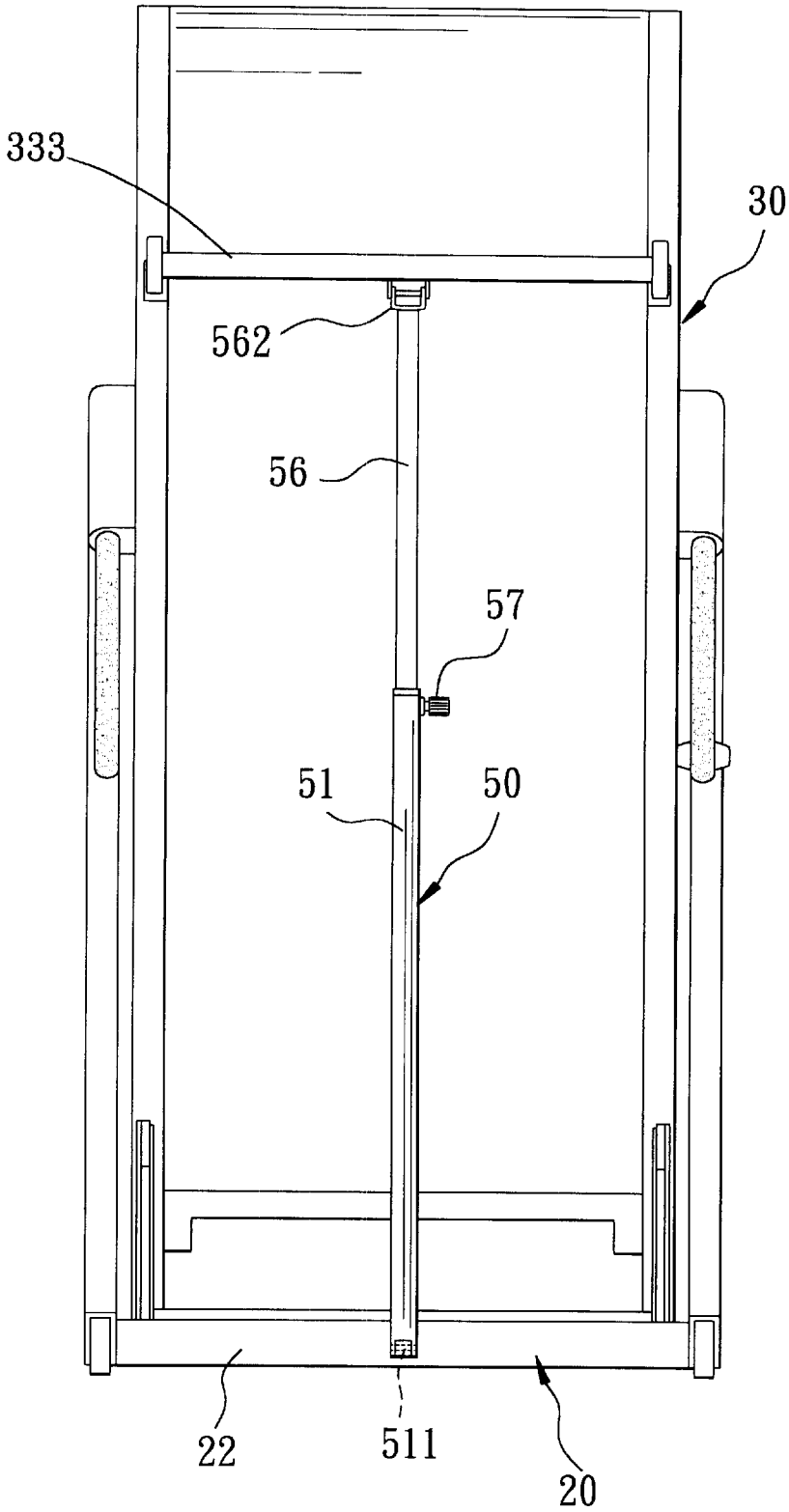
FIG. 3 is a bottom view of the preferred embodiment in a folded position.
Figure 4:
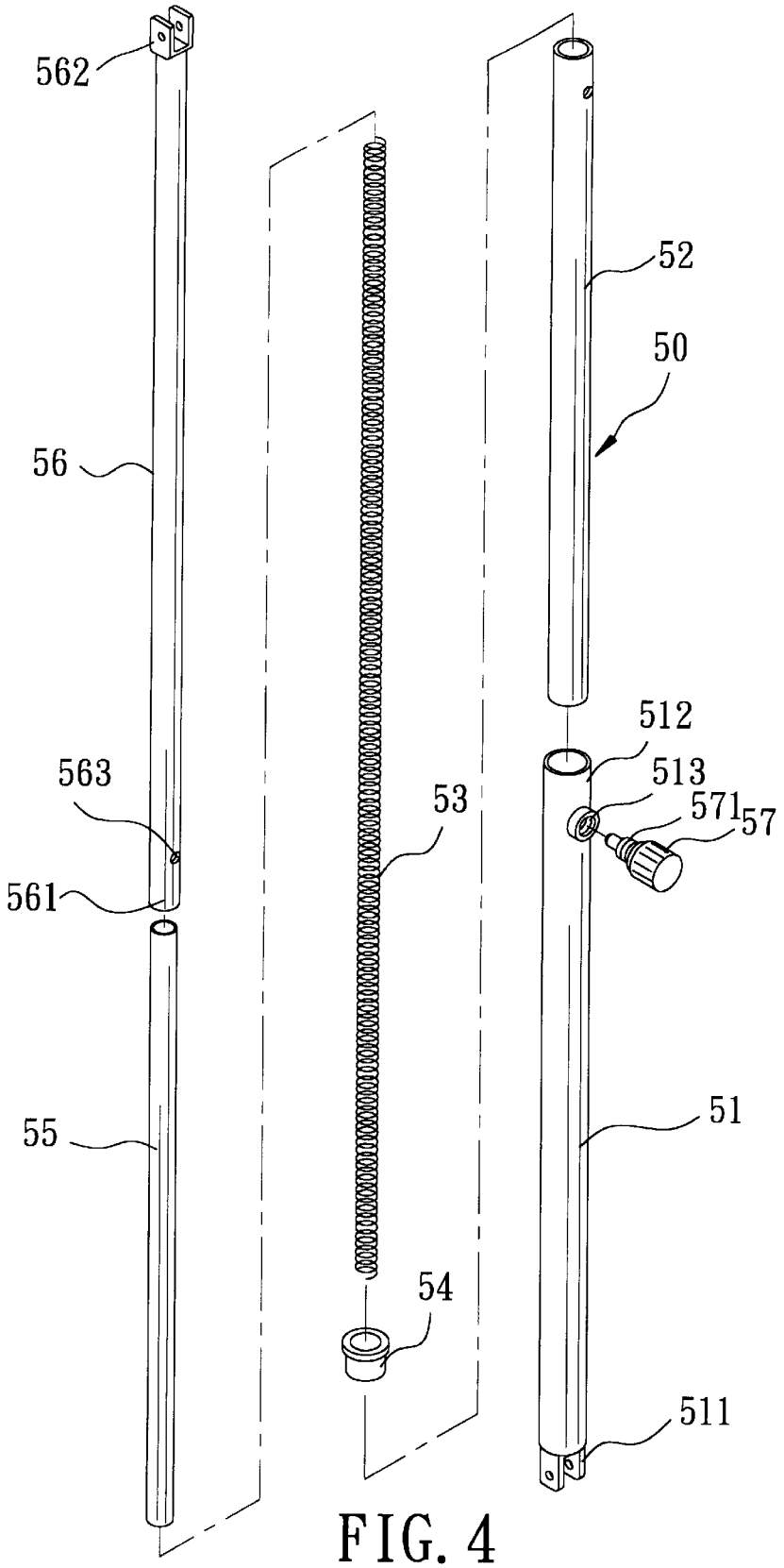
FIG. 4 is an exploded view of a locking device employed in the preferred embodiment shown in FIG. 2.
Figure 5:
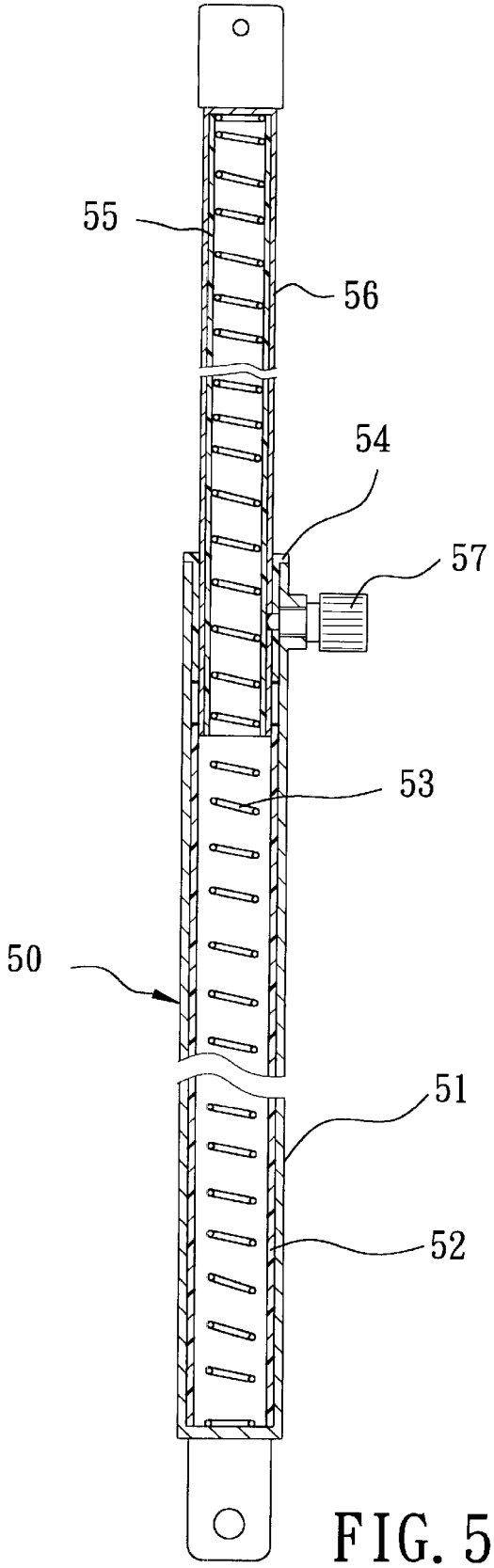
FIG. 5 is an assembled sectional view of the locking device shown in FIG. 4 in a retracted condition.
Figure 6:
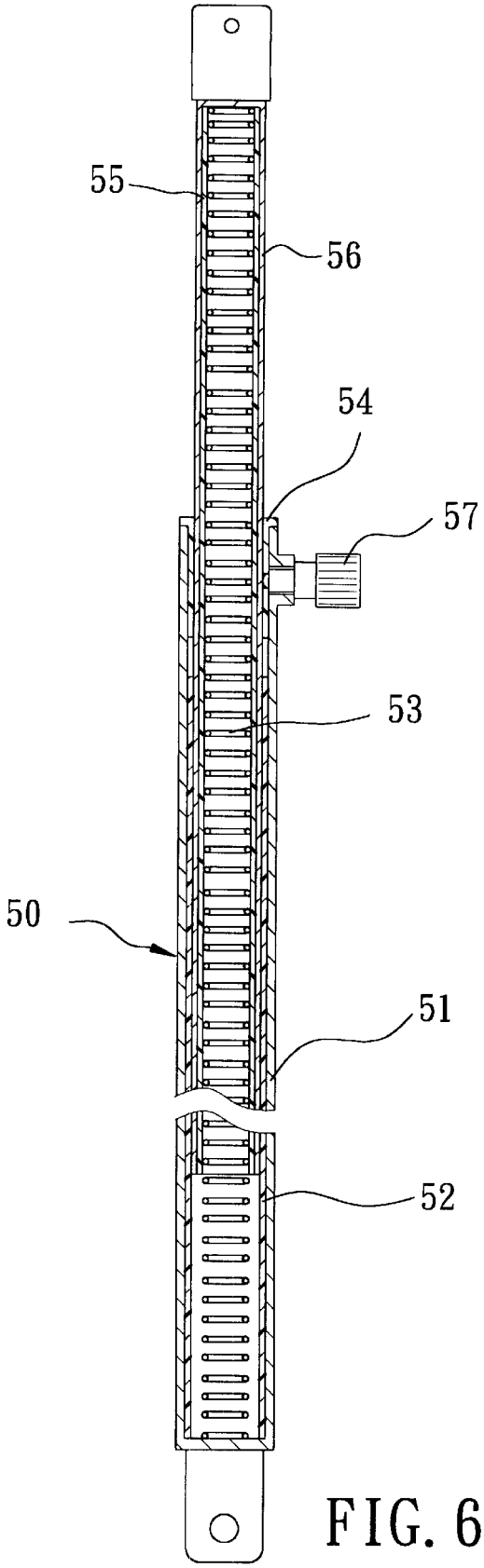
FIG. 6 is an assembled sectional view of the locking device shown in FIG. 4 in an extended condition.

Referring to FIGS. 2 to 6, the preferred embodiment of a treadmill according to this invention is shown to include a base member, an elongated horizontal deck 30, and a locking device 50.

As illustrated, the base member includes a horizontal frame 20 with front and rear portions 21,22, an upright frame 60 that is disposed on and that extends upwardly from the front portion 21 of the horizontal frame 20, and a handle member 70 attached to an upper end of the upright frame 60. The upright frame 60 is in the form of left and right post units 60', a detailed description of the post units 60' will be provided in the following paragraphs. The handle member 70 includes two parallel portions 71 formed with two handgrip mounting holes 711 therein. Each of two handgrip members 90 has an upper end that is mounted fixedly in the respective hole 711 of the handle member 70, and a lower end that is attached to a respective one of the post units 60' such that a user can grip on the handgrip members 90 during use of the treadmill of the present invention.

The horizontal deck 30 is laid over the horizontal frame 20 of the base member, and has a front portion 31 connected pivotally to the front portion 21 of the horizontal frame 20 so that the deck 30 can be turned upwardly on the base member to a folded position, and a rear portion 32 that abuts against the handle member 70 when the deck 30 is rotated to the folded position. A running belt 33 is rotatably mounted around the front and rear portions 31,32 of the deck 30 in a conventional manner.

The locking device 50 includes a front tube 51, a rear tube 56, and a spring-biased lock pin 57. The front tube 51 has a front end 511 connected pivotally to a rear portion 22 of the horizontal frame 20 of the base member, a rear end 512, and a front positioning hole 513 formed in the rear end 512. The rear tube 56 has a rear end 562 that is connected pivotally to the rear portion 32 of the deck 30 via a transverse connecting bar 333, a front end 561 connected telescopically to the rear end 512 of the front tube 51 so that the deck 30 can be folded on the upright post units 60', and a rear positioning hole 563 formed in the rear end 562 such that rotation of the deck 30 to the folded position causes the rear tube 56 to move away from the front tube 51, thereby increasing total length of the front and rear tubes 51,56. The lock pin 57 is disposed on the front tube 51, and is biased by the spring 571 so as to extend through the front and rear positioning holes 513,563 in the front and rear tubes 51,56 when the deck 30 is rotated to the folded position, thereby locking the deck 30 at the folded position.

The locking device 50 further includes a resilient member 53 which is disposed between the front and rear tubes 51,56 so as to bias the front and rear tubes 51,56 away from each other until the lock pin 57 extends through the front and rear positioning holes 513,563 in the front and rear tubes 51,56 during rotation of the deck 30 to the folded position. A compression spring serves as the resilient member 53 which is disposed within the front and rear tubes 51,56 and which has two opposite ends that are fastened respectively to the front end 511 of the front tube 51 and the rear end 562 of the rear tube 56, thereby biasing the front and rear tubes 51,56 away from each other. The locking device 50 further includes two inner tubes 52,55 which are confined within the front and rear tubes 51,56, respectively, and which receive the compression spring 53 therewithin. The inner tubes 52,55 have diameters that are slightly larger than that of the compression spring 53, thereby preventing the compression spring 53 from flexing within the front and rear tubes 51,56. A tube-coupling ring 54 is disposed between the front and rear tubes 51,56 to prevent disengagement therebetween when the rear tube 56 moves away from the front tube 51 by virtue of rotation of the deck 30 to the folded position.

Figure 7:
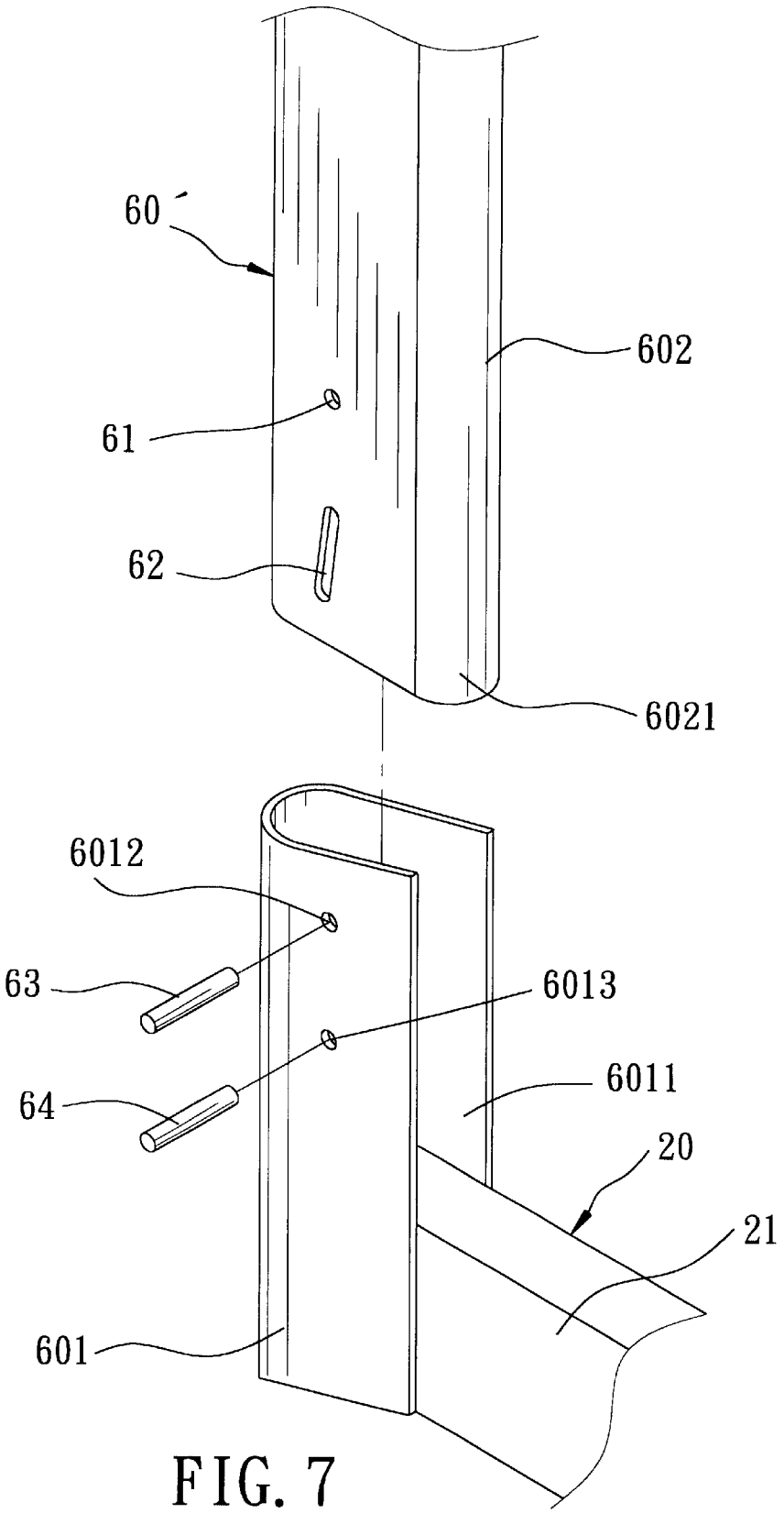
FIG. 7 is a partly exploded fragmentary view of the preferred embodiment, illustrating how an upright frame is mounted on a horizontal frame in the preferred embodiment.
Figure 8:
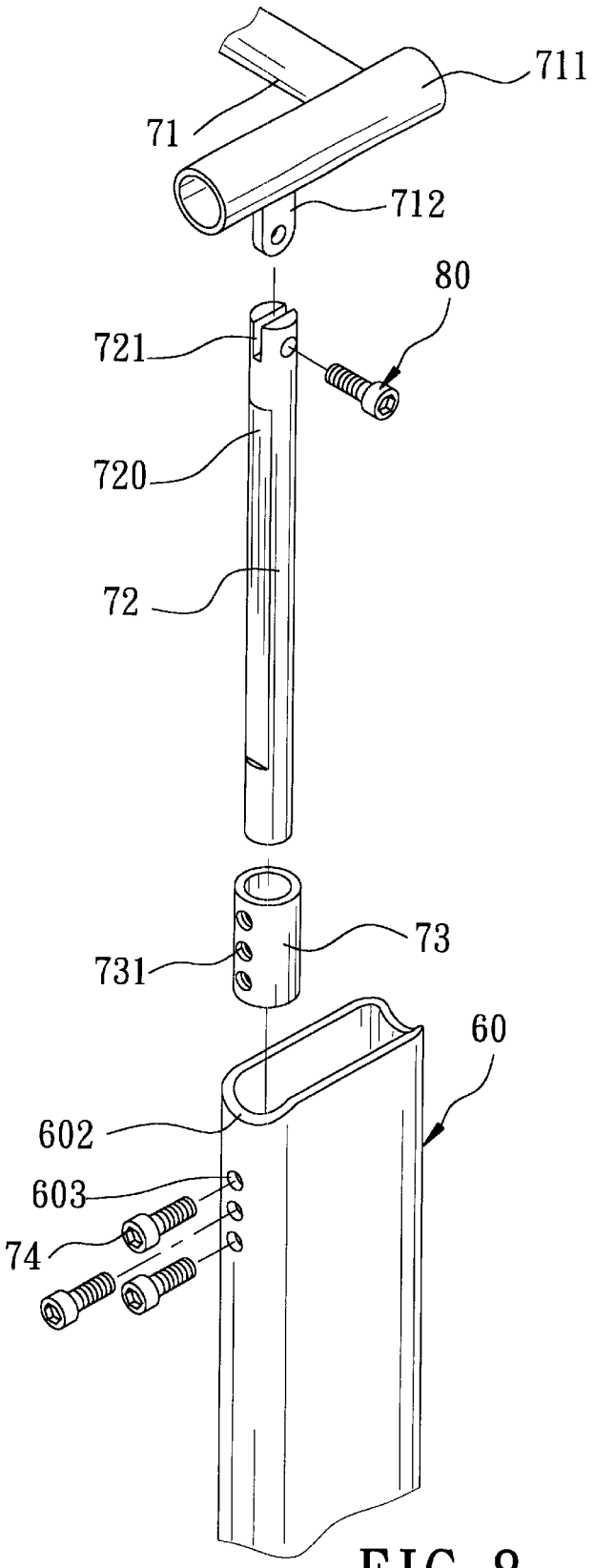
FIG. 8 is an exploded fragmentary view of the preferred embodiment, illustrating how a handle member is mounted on the upright frame in the preferred embodiment.
Figure 9:
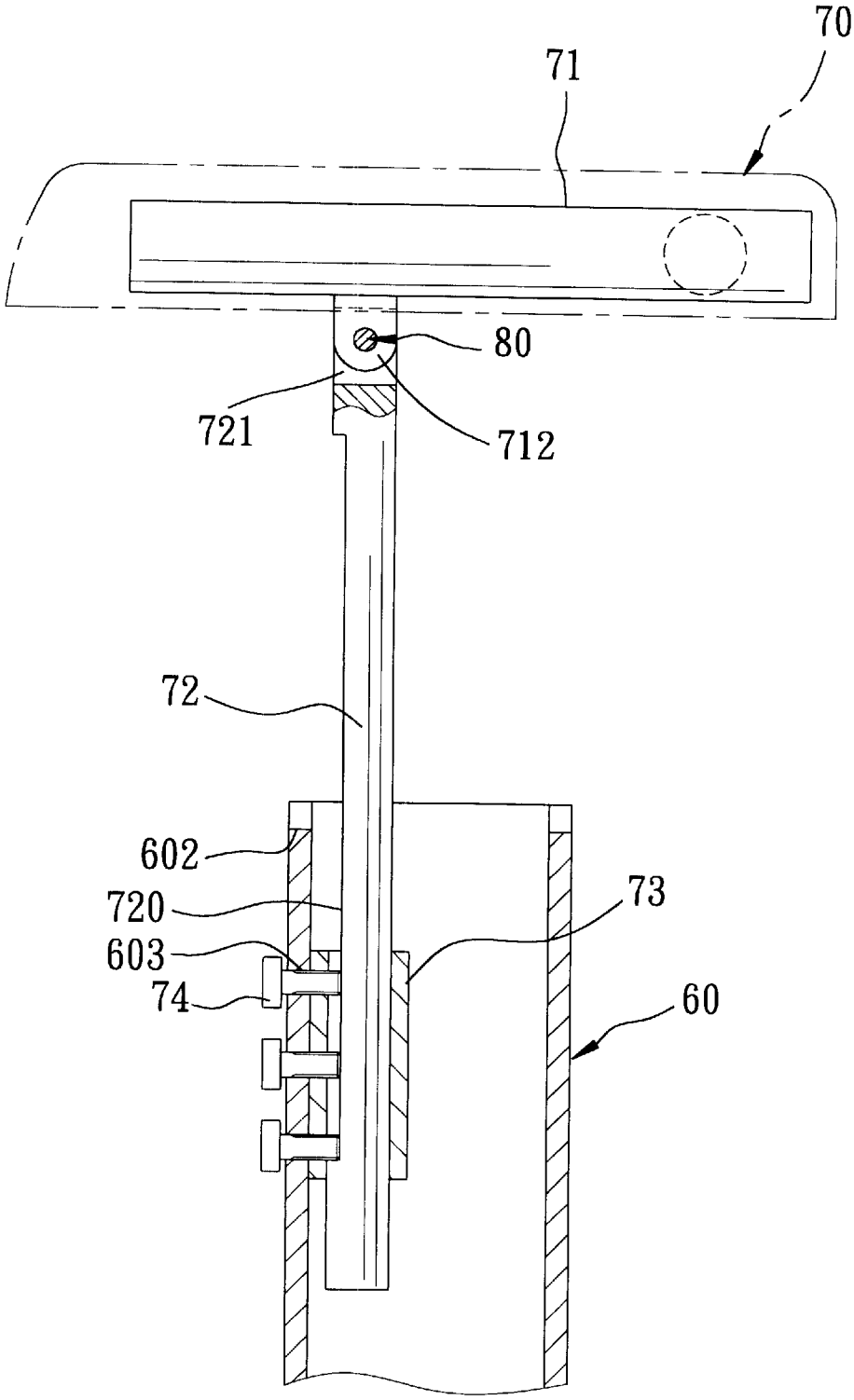
FIG. 9 is a fragmentary sectional view of the preferred embodiment, illustrating how the handle member is mounted on the upright frame in the preferred embodiment.

Referring to FIGS. 7 to 9, each of the post units 60' further includes a handle-supporting post 602 and a U-shaped-cross-sectioned mounting bracket 601 that opens at a rear end thereof and that defines a post-accommodating space 6011 therewithin. Each of the handle-supporting posts 602 is inserted into the post-accommodating space 6011 in the mounting bracket 601 at a lower end portion thereof. Each of the mounting brackets 601 has an upper hole unit 6012 and a lower hole unit 6013 that is located under the upper hole unit 6012 in the mounting bracket 601. The lower end portion 6021 of each of the handle-supporting posts 602 has an upper hole unit 61 and an inclined lower slot unit 62 that is located under the upper hole unit 61 in the handle-supporting post 602. Each of the post units 60' further includes an upper pin 63 that is mounted removably on a respective one of the mounting brackets 601 and that extends through the upper hole unit 6012 in a respective one of the mounting brackets 601 and the upper hole unit 61 in a respective one of the handle-supporting posts 602, and a lower pin 64 that extends through the lower hole unit 6013 in the respective one of the mounting brackets 601 and the lower slot unit 62 in a respective one of the handle-supporting posts 602.

Figure 10:
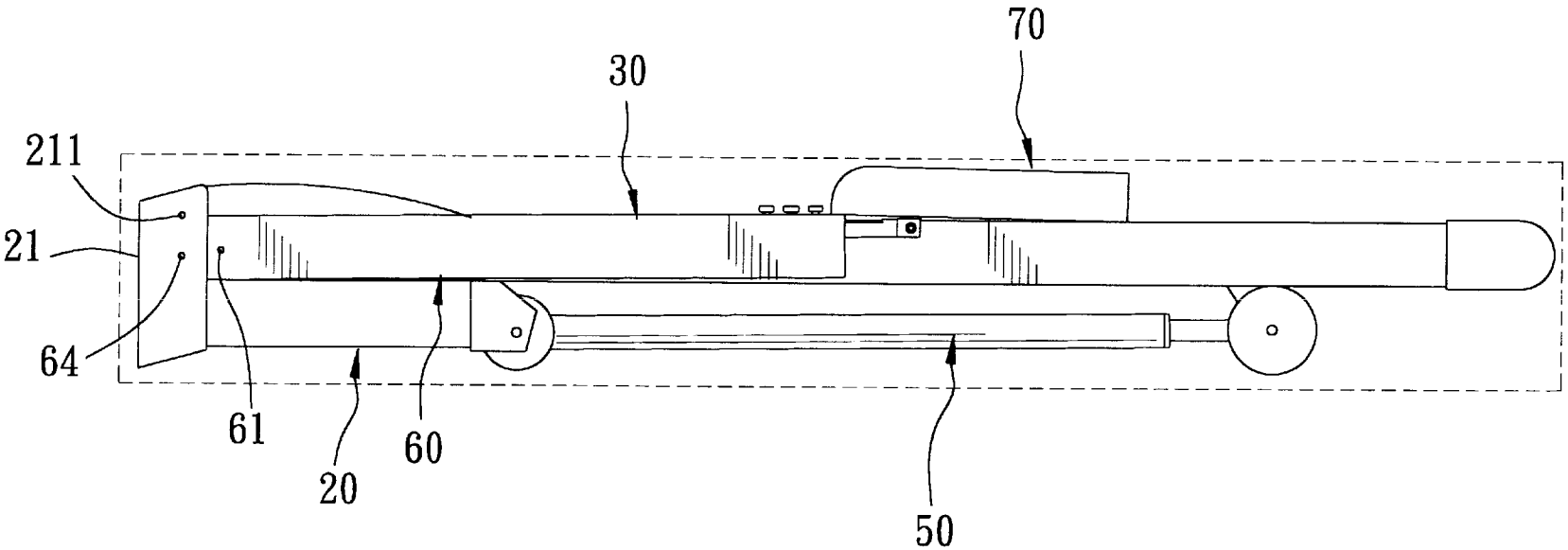
FIG. 10 illustrates how the preferred embodiment is packed for transport.

The upper pins 63 can be removed from the mounting brackets 601 and the handle-supporting posts 602 so as to permit rotation of the handle-supporting posts 602 about the lower pins 64, thereby folding the handle-supporting posts 602 on the horizontal frame 20 of the base member when the deck 30 is laid over the horizontal frame 20. The handle member 70 further has two lugs 712 which extend downwardly and integrally from the parallel portions 71 thereof (only one is shown in FIG. 8). Each of the handle-supporting posts 602 is U-shaped-cross-sectioned, and is further formed with a lock hole unit 603 consisting of three lock holes. A vertical connecting rod 72 is inserted into a respective one of the handle-supporting posts 602, and has a bifurcated upper end 721 connected pivotally to a respective one of the lugs 712, and a vertical groove 720 formed in an intermediate portion thereof. A tubular vertical sleeve 73 is disposed within a respective one of the handle-supporting posts 602, and has a lock hole unit 731 consisting of three lock holes. A lock bolt 74 consists of three lock bolts, each of which extends through the lock hole units 603,731 in a respective one of the handle-supporting posts 602 and the sleeve 73 to press against the connecting rod 72 in such a manner that the lock bolts 74 are inserted into the grooves 720 in the connecting rods 72. Under this condition, loosening of the lock bolts 74 from the connecting rods 72 can result in retraction of the connecting rods 72 into the handle-supporting posts 602 so as to dispose the handle member 70 over the handle-supporting posts 602. Removal of the lock pins 63 from the mounting brackets 601 and the handle-supporting posts 602 further permits rotation of the handle-supporting posts 602 about the lower pins 64, thereby folding the handle-supporting posts 602 on the horizontal frame 20 of the base member when the deck 30 is laid over the horizontal frame 20, while the handle member 70 is disposed over the handle-supporting posts 602 by virtue of pivotal action of the handle member 70 relative to the connecting rods 72, as best shown in FIG. 10.

Some of the advantages provided by the treadmill of the present invention are as follows:

(1) Since the deck 30 is locked at the folded position by the locking device 50, falling of the deck 30 over the horizontal frame 20 can be avoided.

(2) The treadmill of the present invention can be folded into a relative small volume so as to minimize the space occupied thereby during transport of the same.

With this invention thus explained, it is apparent that numerous modifications and variations can be made without departing from the scope and spirit of this invention. It is therefore intended that this invention be limited only as indicated by the appended claims.

I claim:

1. A treadmill comprising:

a base member including a horizontal frame with front and rear portions, and an upright frame disposed on and extending upwardly from said front portion of said horizontal frame, and having a handle member attached to an upper thereof;

an elongated horizontal deck laid over said horizontal frame of said base member, and having a front portion pivotally connected to said front portion of said horizontal frame so that said deck can be turned upwardly on said base member to a folded position, and a rear portion that abuts against said upright frame when said deck is rotated to said folded position; and a locking device including a front tube having a front end that is connected pivotally to said rear portion of said horizontal frame of said base member, a rear end, and a front positioning hole formed therein, a rear tube having a rear end that is connected pivotally to said rear portion of said deck, a front end that is connected telescopically to said rear end of said front tube so that said deck can be folded on said upright frame of said base member, and a rear positioning hole formed therein, rotation of said deck to said folded position causing said rear tube to move away from said front tube, thereby increasing total length of said front and rear tubes, and a spring-biased lock pin disposed on one of said front and rear tubes and biased to extend through said front and rear positioning holes in said front and rear tubes when said deck is rotated to said folded position, thereby locking said deck at said folded position.

2. The treadmill as defined in claim 1, wherein said locking device further includes a resilient member which is disposed between said front and rear tubes so as to bias said front and rear tubes away from each other until said lock pin extends through said front and rear positioning holes in said front and rear tubes during rotation of said deck to said folded position.

3. The treadmill as defined in claim 2, wherein said resilient member is a compression spring which is disposed within said front and rear tubes and which has two opposite ends that are fastened respectively to said front end of said front tube and said rear end of said rear tube, thereby biasing said front and rear tubes away from each other.

4. The treadmill as defined in claim 3, wherein said locking device further includes two inner tubes which are confined within said front and rear tubes, respectively, and which receive said compression spring therewithin, said inner tubes having diameters that are slightly larger than that of said compression spring, thereby preventing said compression spring from flexing within said front and rear tubes.

5. The treadmill as defined in claim 1, wherein said upright frame of said base member has left and right post units, each of which includes a U-shaped-cross-sectioned mounting bracket that opens at a rear end thereof and that defines a post-accommodating space therewithin, and a handle-supporting post that is inserted into said post-accommodating space in said mounting bracket at a lower end portion thereof, each of said mounting brackets having an upper hole unit and a lower hole unit that is located under said upper hole unit in said mounting bracket, said lower end portion of each of said handle-supporting posts having an upper hole unit and an inclined lower slot unit that is located under said upper hole unit in said handle-supporting post, each of said left and right post units further including an upper pin that is mounted removably on a respective one of said mounting brackets and that extends through said upper hole unit in a respective one of said mounting brackets and said upper hole unit in a respective one of said handle-supporting posts, and a lower pin that extends through said lower hole unit in a respective one of said mounting brackets and said lower slot unit in a respective one of said handle-supporting posts, said upper pins being removable from said mounting brackets so as to permit rotation of said handle-supporting posts about said lower pins, thereby folding said handle-supporting posts on said horizontal frame when said deck is laid over said horizontal frame of said base member.

6. The treadmill as defined in claim 5, wherein said handle member has two downwardly extending integral lugs, each of said handle-supporting posts being hollow and being formed with a lock hole unit, each of said left and right post units further including:

a vertical connecting rod inserted into a respective one of said handle-supporting posts, and having an upper end that is connected pivotally to a respective one of said lugs, and a vertical groove formed in an intermediate portion thereof;

a vertical sleeve disposed within a respective one of said handle-supporting posts and having a lock hole unit; and a lock bolt unit extending through said lock hole units in a respective one of said handle-supporting posts and said sleeve to press against said connecting rod in such a manner that said lock bolt unit is inserted into said groove in said connecting rod.

* * * * *